US006230670B1

(12) United States Patent
Russell

(10) Patent No.: US 6,230,670 B1
(45) Date of Patent: May 15, 2001

(54) ENGINE GENERATOR

(76) Inventor: Robert L. Russell, 979 Walnut Ridge Ct., Frankfort, IL (US) 60423

( * ) Notice: Subject to any disclaimer, the term of this patent is extended or adjusted under 35 U.S.C. 154(b) by 0 days.

(21) Appl. No.: 09/252,763

(22) Filed: Feb. 19, 1999

(51) Int. Cl.[7] ..... F02B 57/08
(52) U.S. Cl. ..... 123/44 B; 123/44 E
(58) Field of Search ..... 123/44 R, 44 B, 123/44 C, 44 D, 44 E

(56) References Cited

U.S. PATENT DOCUMENTS 2,920,611 * 1/1960 Casini ..... 123/44 E
4,334,506 * 6/1982 Albert ..... 123/44 E
4,653,438 * 3/1987 Russell ..... 123/44 B
5,636,599 * 6/1997 Russell ..... 123/44 B
5,701,930 * 12/1997 Russell ..... 123/44 B

FOREIGN PATENT DOCUMENTS

562391 * 5/1975 (CH) ..... 123/44 E
1809564 * 7/1970 (DE) ..... 123/44 D
436702 * 1/1912 (FR) ..... 123/44 B
7415906 * 6/1976 (NL) ..... 123/44 E

* cited by examiner

*Primary Examiner*—Michael Koczo
(74) *Attorney, Agent, or Firm*—McCaleb, Lucas & Brugman

(57) ABSTRACT

A mechanical fuel cell, in which a novel two cycle type, six cylinder, twin cam, internal combustion rotary engine, operable generally at constant speed, drives a plurality of magnets over a stationary wire coil to generate electrical energy.

7 Claims, 15 Drawing Sheets

A
B
C
D
E
F
G
H
I
J
K
L
M
N
O
P
Q
R
S
T
U
V
W
X
Y
Z
30
31

ENGINE GENERATOR

This invention relates to mechanical/electrical generators and more particularly to improvements in mechanical internal combustion engine and electrical generator combinations for producing electrical energy.

BACKGROUND OF THE INVENTION

From early times man has sought better and easier ways of performing his day to day tasks, which required some form of energy to accomplish. In the earliest of times man could only count on his own energy to carry out these tasks. Eventually he had fire, then domesticated animals, soon he learned to make and use steam, and then came the internal combustion engine. Shortly thereafter came electricity. From the very beginning of the electric age man recognized the power of electricity, although he didn't know just what to do with it. He still used his own hands, the hands of friends, his livestock, steam engines and the internal combustion engine which was growing in popularity with each passing day. Electricity as we have learned, provides us with almost anything we need in the course of our lives from birth to death. Without electricity there would be no refrigerators, microwaves, televisions, radios, computers or a host of other electrified instruments useful to man. One only has to experience an electrical black-out to readily appreciate the vast array of uses electricity has been put to. As a matter of fact, man has now become almost completely dependent on electricity for every facet of life, whether at work or at home. Without it, he is in the dark, like his cave dwelling forefathers were and yet power failures are more frequent and longer than ever. Some power companies have even resorted to the tactic of strategic black-outs during the worst days of electrical demand, particularly in summertime due to the heavy demand of running air conditioners. One answer to the problem of electrical shortage is to buy more electricity from neighboring producers of electrical power, but this is not a long term solution.

Currently there is more demand for electricity. New uses for electricity are found everyday. As our population grows, new homes spring up everywhere, more factories are built to make more products and to supply jobs for all the new workers and for all that we require even more electricity. While the construction of new power plants is relatively infrequent, the need for emergency electric power generators has become common. Although the demand for emergency generators that are economical to use, dependable and affordable has never been greater this demand will be even greater in the future.

This invention seeks to meet the aforenoted demand and need for a portable, relatively light-weight, highly efficient, economical generator utilizing an internal combustion engine for driving an electro-magnetic coil to produce electrical energy.

BRIEF SUMMARY OF THE INVENTION

This invention is directed to an improved stationary or portable electrical energy source employing an internal combustion engine and generator combination and more specifically comprises a novel rotary internal combustion engine which integrates an electrical generator with an engine rotor. The engine's combustion cylinders and pistons travel along endless twin-cam tracks and preferably operate generally similar to a two-cycle engine at relatively fixed speeds to provide a highly efficient and powerful, small, lightweight internal combustion engine of flexible design capable of efficient operation while using a wide range of hydrocarbon fuels and at the same time maintaining an efficient low cost of production.

An important object of this invention, is to provide an internal combustion engine having vastly improved flexibility of design for all facets of infinitely variable combustion and subsequent power conversion.

Another important object of this invention is to provide an internal combustion engine having a prolonged dwell at the top of the piston stroke whereby the ignited air/fuel mixture in the cylinder is allowed to combust more completely while the piston is substantially stationary relative to its position in a related cylinder.

Yet another important object of this invention is to provide an internal combustion engine having a prolonged dwell at the top of the piston stroke whereby the ignited air/fuel mixture in the cylinder is allowed to expand more completely to provide a means to generate much greater internal cylinder pressure while the piston is substantially stationary relative to its position in a related cylinder.

Yet another important object of this invention is to provide an internal combustion engine requiring no form of head gasket which would limit the engines ability to withstand extremely high cylinder pressures.

Still another important object of this invention is to provide an internal combustion engine having an infinitely variable cam track configuration such that the most efficient transformation of the linear motion of a piston into the rotary motion of the engine/generators rotor can be achieved.

Another important object of this invention is to provide an internal combustion engine having prolonged dwell at the bottom of piston stroke whereby exhaust of spent gases is accomplished while the piston is substantially stationary relative to its position in a related cylinder.

Still another important object of this invention is to provide an internal combustion engine in which there is prolonged dwell at the bottom of a piston stroke such that each piston carrying cylinder may be cleaned or purged of all spent gases while the piston is generally stationary relative to its cylinder.

A still further object of this invention is to provide prolonged dwell at the bottom of the piston stroke in a multi-cylinder internal combustion engine whereby each cylinder is cleaned, purged and air cooled internally while exhaust valves are held open in a prolonged substantially stationary position.

Still another important object of this invention is to provide a two cycle, multiple cylinder and piston, internal combustion engine in which each piston has a prolonged dwell period, such that a related cylinder exhaust valve is in a complete state of closure prior to the introduction of fuel into the cylinder.

An additional object of this invention is to provide an internal combustion, two cycle engine embodying means productive of a prolonged dwell at the bottom of each piston stroke such that charging of a cylinder with fuel for the next combustion is accomplished while the piston is generally stationary relative to its cylinder.

A still additional object of this invention is to provide an internal combustion engine employing endless opposed twin cams for regulating piston movement with the twin cams providing an infinitely variable compression stroke for each piston to optimize combustion of a selectively suitable fuel.

A still further important object of this invention is to provide a two cycle style rotary engine embodying cam means capable of dictating multiple firings of each cylinder for each complete engine rotor revolution.

A further and most important object of this invention is to provide an internal combustion engine designed for use in a unitary engine/generator embodying the features of the aforestated objects.

Another important object of this invention is to provide a mechanical electrical means for generating electrical energy utilizing an internal combustion engine such that the rotary mass of an engine rotor assembly is the armature of the generator unit.

An overall object of this invention is to provide a compact, lightweight, means providing a highly efficient source of portable and stationary electrical power, and which is dependable in use, economical to manufacture and friendly to the environment.

Having described this invention, the above and further objects, features and advantages thereof will become readily apparent to those skilled in the art from the following detailed description of a preferred embodiment illustrated in the accompanying drawings.

DESCRIPTION OF THE PREFERRED EMBODIMENT

The description which follows will set forth the features of a currently preferred embodiment of this invention and more specifically will describe the features of a mechanical engine/generator utilizing a two-cycle type, six-cylinder, twin-cam, rotary piston engine designed to run at a relative fixed rpm or speed and produce 220 volts of 3 phase alternating current. This is not the only form that the engine/generator of this invention can take, nor is it the only form of electrical energy it can produce. However, the herein described and illustrated form of this invention is the best mode presently contemplated to enable those skilled in the art to practice this invention.

Figures 1, 1A:
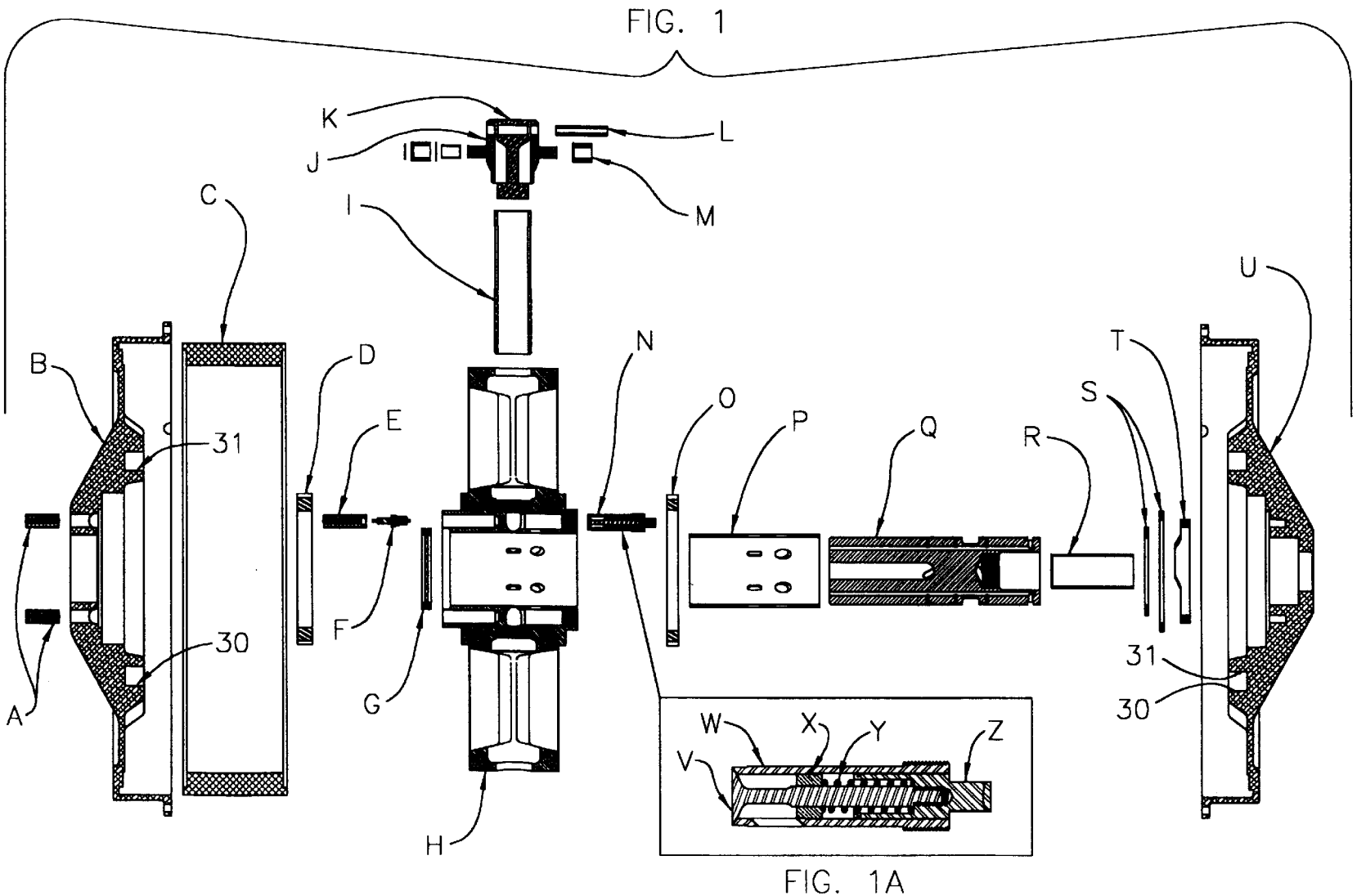
FIG. 1 is an exploded view of the engine/generator showing the major parts of the engine/generator referenced in the hereinafter appearing description of this invention.
FIG. 1A is an enlarged cross sectional view of the valve assembly designated N in FIG. 1.

As noted, FIG. 1 is an exploded view of the engine/generator of this invention illustrating its several major parts which will be referenced from time to time in the description of this invention to follow.

It will be noted that the elemental portions of the engine/generator illustrated in FIG. 1 are labeled by alphabetic letters for ease in tracking such designated parts throughout the ensuing drawing figures.

As shown the several parts, the number required and letter designation for each are as listed below:

| Letter | Required | Description |
|---|---|---|
| A | 2 | Insulated electrodes for providing ignition energy to spark plugs |
| B | 1 | A front end case making up one half of the engine housing |
| C | 1 | Stationary electric coil of the generator |
| D | 1 | Front ring gear |
| E | 6 | Spark plug insulators |
| F | 6 | Spark plugs |
| G | 1 | Front thrust bearings |
| H | 1 | Engine rotor |
| I | 6 | Cylinders |
| J | 6 | Cylinder sleeves |
| K | 6 | Pistons |
| L | 6 | Wrist pins |
| M | 12 | Cam roller assemblies |
| N | 6 | Valve assemblies |
| O | 1 | Back ring gear |
| P | 1 | Main bearing |
| Q | 1 | Main shaft |
| R | 1 | Exhaust pipe |
| S | 2 | Back thrust bearing |
| T | 1 | Exhaust valve cam ring |
| U | 1 | Back end case |
| V | 6 | Valve stems |
| W | 6 | Valve bodies |
| X | 6 | Valve guides |
| Y | 6 | Valve springs |
| Z | 6 | Exhaust valve cam followers |

Figure 2A:
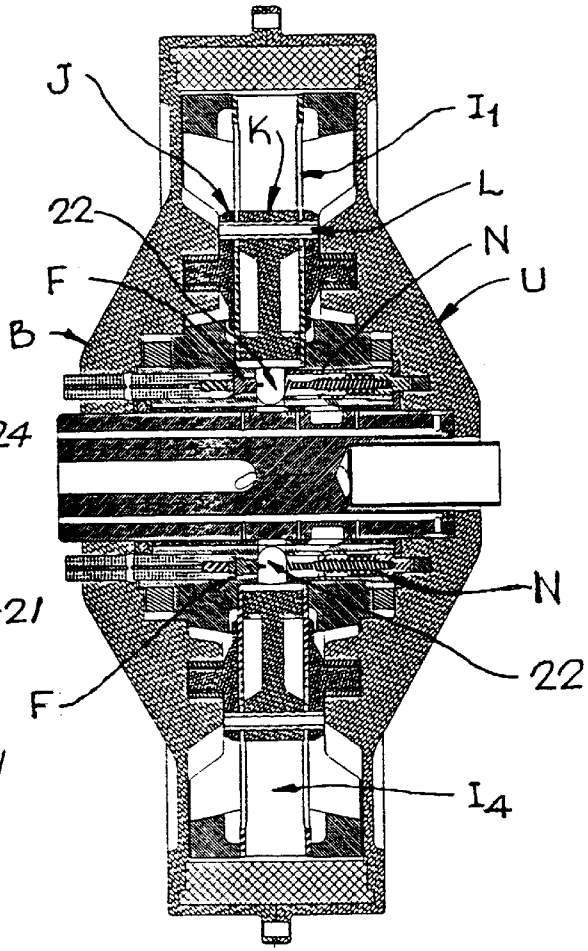
FIG. 2A is a full cross sectional view taken substantially along section line 2A—2A of FIG. 2, but assembled with the removed end case of FIG. 2 to illustrate the assembled arrangement of parts therein.
Figure 2:
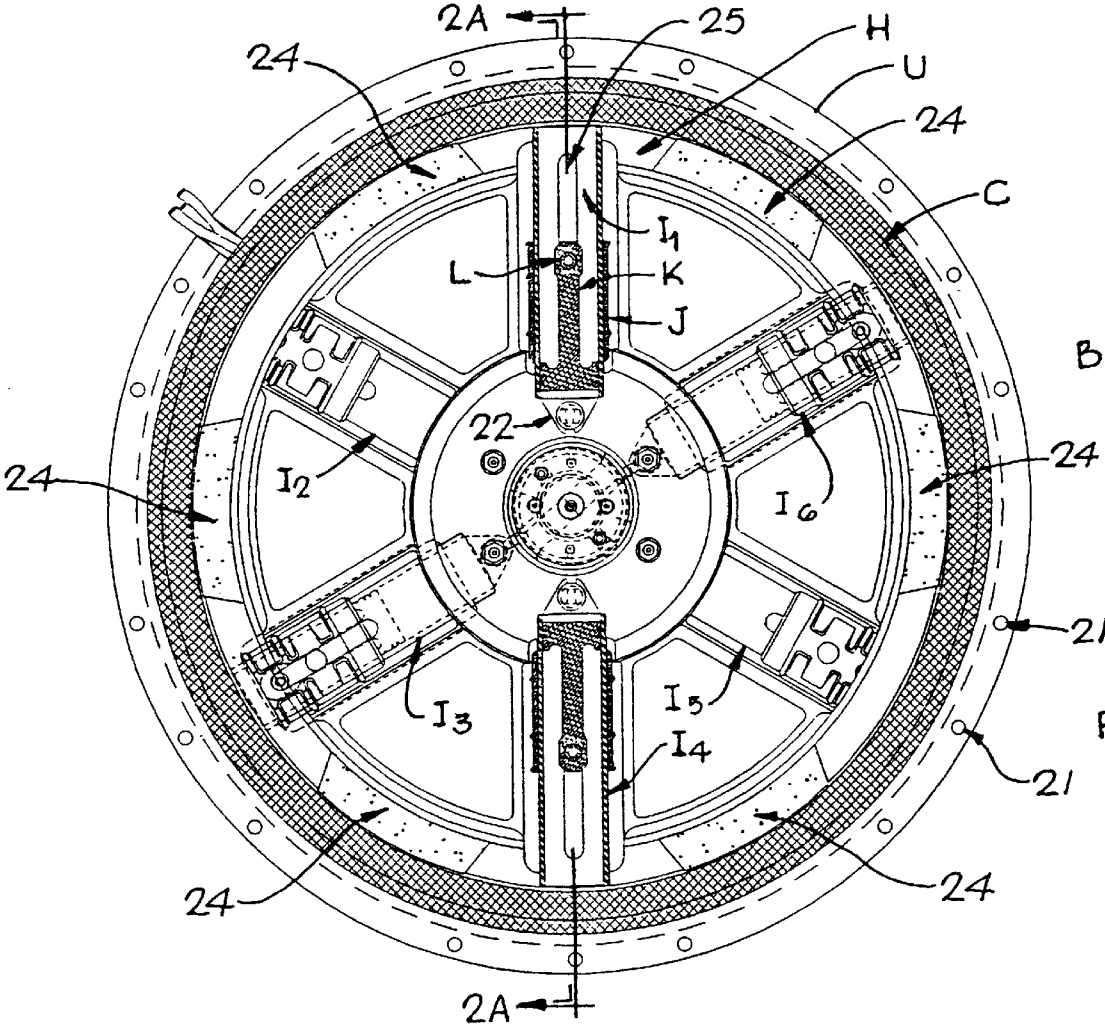
FIG. 2 is an end elevational view of the assembled unit illustrated in FIG. 1 with a front end case thereof removed and showing certain cylinders and pistons of the engine in full elevation and others in cross section.

Turning now to FIG. 2 of the drawings it will be realized that for clarity the front end case B of the engine is not shown in this view or in the following FIGS. 3–5. The back end case U is shown, however, as well as twelve (12) assembly bolt holes 20 and six (6) alignment dowels 21. It also will be noted from this figure that the six (6) cylinders are shown in three different ways, i.e., full line showing, full line with hidden lines and a full sectional view taken through the center of two opposed cylinder assemblies (I)1 and (I)4, each having a piston (K), cylinder sleeve (J), wrist pin (L) and associated combustion chamber 22 (see FIG. 2A).

In FIG. 2A, the assembled relationship of the several parts shown in FIG. 2, as well as the front and back case members (B) and (U) of the engine housing are illustrated. It also will be noted that rotor (H), as shown in FIG. 2, carries six (6) arcuate shaped permanent magnets 24 mounted about its periphery and located between adjacent piston and cylinder assemblies.

From the full cross sectional view of FIG. 2A showing the assembly of parts for the engine/generator, it will be noted that the engine hereof is in many respects similar to the teaching and disclosure of a four cycle engine set forth in my prior U.S. Pat. No. 4,653,438 issued Mar. 31, 1987, entitled "Rotary Engine". Certain exceptions to the rotary engine of that patent are found in the cylinder assemblies hereof employing threadingly detachable cylinders (I), cylinder sleeves (J), pistons (K), wrist pins (L) and cam rollers (M), which are specifically described in my prior U.S. Pat. No. 5,636,599, issued Jun. 10, 1997, entitled "Improved Cylinder Assembly".

Similarly, each modular poppet valve assembly embodying items (V), (W), (X), (Y) and (Z), shown at (N) in FIG. 1 hereof and the enlarged assembly view 1A as well, is more fully described in my U.S. Pat. No. 5,701,930, issued Dec. 30, 1997, entitled "Modular Valve Assembly". The specifics of the present engine structure, set out in the several above mentioned patents will not be described further herein, except for the marrying of generator and engine and the functional results thereof, as will appear in great particular presently.

In general it is to be understood that the engine portion of the engine generator comprises a rotor member (H in FIG. 1), which rotates with a main bearing (P in FIG. 1) supported on a central main shaft (Q) which has a number of port openings and internal passageways for the flow of air and fuel to the individual cylinders and piston assemblies, (there being six (6) in the particular embodiment hereof) and the eventual exhaust of spent fuel and gases through an exhaust pipe (R) extending coaxially from one end of the main shaft (Q). Operation of the several piston cylinder assemblies (I) is in accordance with the design dictates of a pair of radially separated, opposed twin track cam surfaces 30 and 31 as will be described in greater detail hereafter.

In response to ignition and explosion of a selected fuel in an associated combustion chamber 22 (see FIGS. 2 and 2A) at the radially innermost end of each cylinder, an associated piston K moves radially outwardly along the interior of a related cylinder. Wrist pins (L) extending outwardly through elongated slots 25 in the walls of each cylinder (I) interjoin each piston (K) with its associated sleeve member (J); the latter riding over the exterior of its associated cylinder. Cam follower roller assemblies (M) (see FIG. 4), engagable with the opposing cam tracks formed in the two housing halves or cases (B) and (U), regulate radial movements of the pistons within their respective cylinders and relative to the main shaft (Q) to effectively rotatably drive the rotor about the main shaft Q. This described relationship is generally in accordance with the arrangement of parts and operation described more fully in my aforenoted U.S. Pat. No. 4,653,438 although the engine of that patent, is a four cycle type and thus differs materially from the present engine particularly as to piston movements and piston reversal dictated by the twin cam means of the present engine.

Inasmuch as the current engine is designed to have six (6) cylinders it will be noted from FIG. 2, for example, that opposing cylinder and piston assemblies are fired simultaneously whereby the pistons in those cylinders move in opposite directions simultaneously at diametrically opposed positions. This serves to balance forces from the firing and explosion of fuel in opposed cylinders. In this respect it will be noted from FIG. 2A in particular that the actual ignition and firing of fuel takes place in separate combustion chambers 22 disposed between the valve assemblies (N) and the spark plugs (F) which invade the combustion chambers in a known fashion.

Figure 3A:
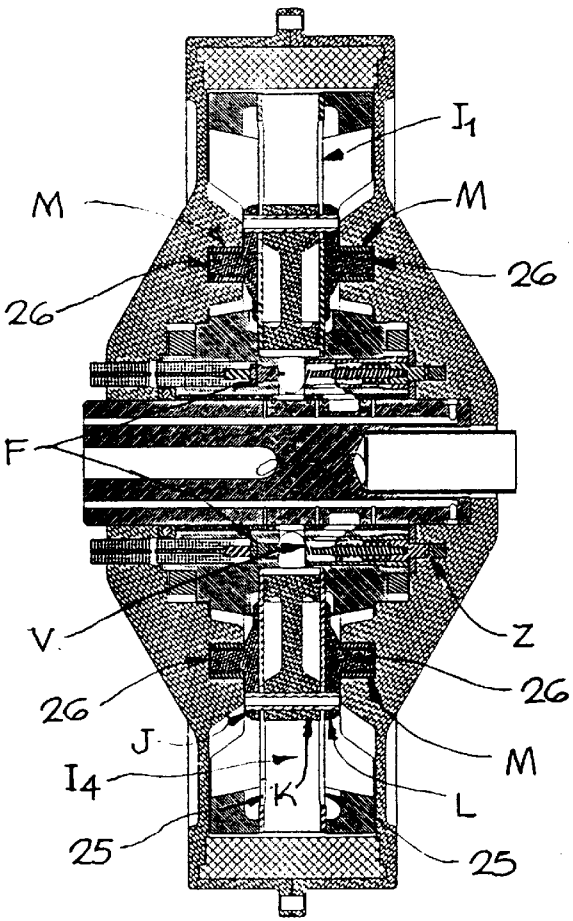
FIG. 3A is a full cross sectional view with assembled front end case similar to FIG. 2A taken substantially along vantage line 3A—3A of FIG. 3 and looking in the direction of the arrows thereon.
Figure 3:
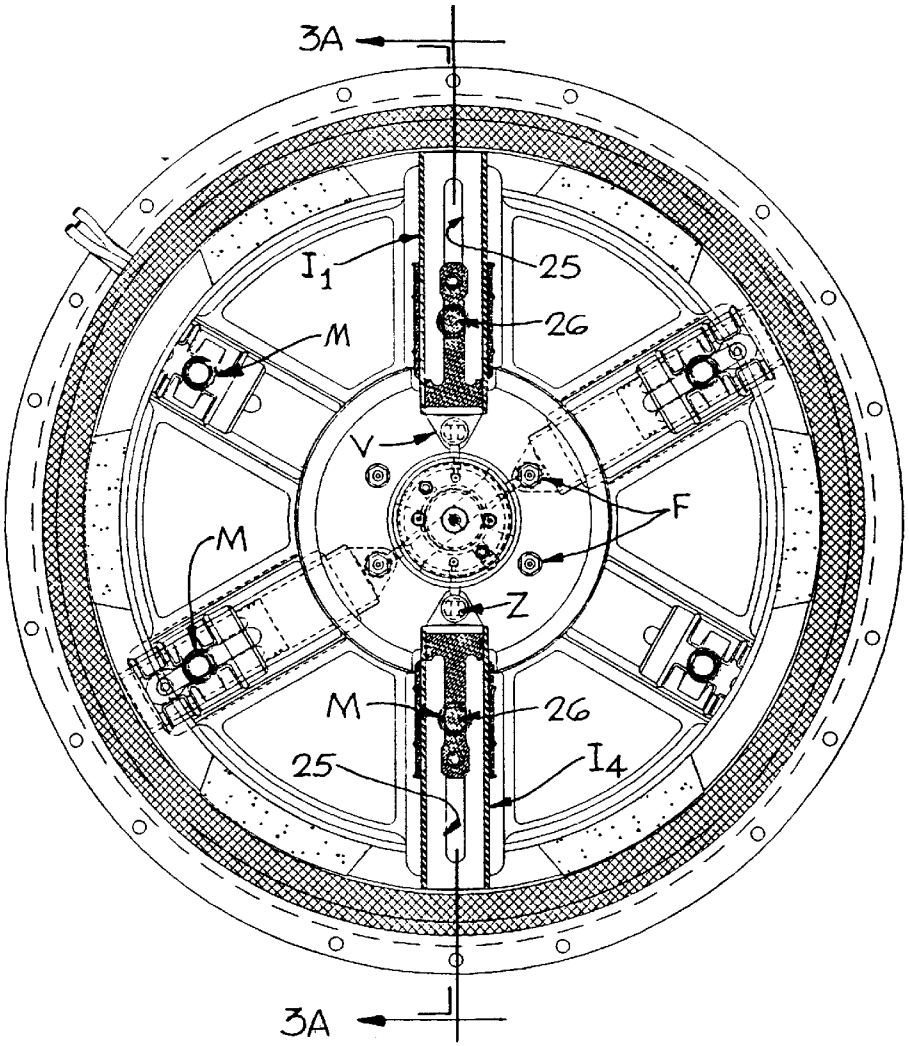
FIG. 3 is an end elevational view with the front end case removed, similar to FIG. 2, showing cam rollers and spark plugs not shown in FIG. 2.

FIGS. 3 and 3A are quite similar to FIGS. 2 and 2A although the spark plugs (F) are visibly marked in FIG. 3. In sectional view 3A, valve stem (V) is shown and labeled as such while the exhaust valve cam follower (Z) and the spark plugs (F) are all clearly shown in that figure.

Examining both FIGS. 3 and 3A it will be understood that a piston (K) within cylinder (I)4 and its associated cylinder sleeve (J) mounted about the exterior of the cylinder are interjoined by wrist pin (L) which passes through slots 25 in diametrically opposed sides of the cylinder walls. The cylinder sleeve (J) is formed with cylindrical exterior coaxial trunnions 26 extending from diametrically opposite sides thereof on which are rotatable mounted cam roller bearings (M). It is apparent that all six cylinder assemblies are equipped with pistons (K), sleeves (J), wrist pins (L) and cam roller bearings (M) as above related.

Figure 4A:
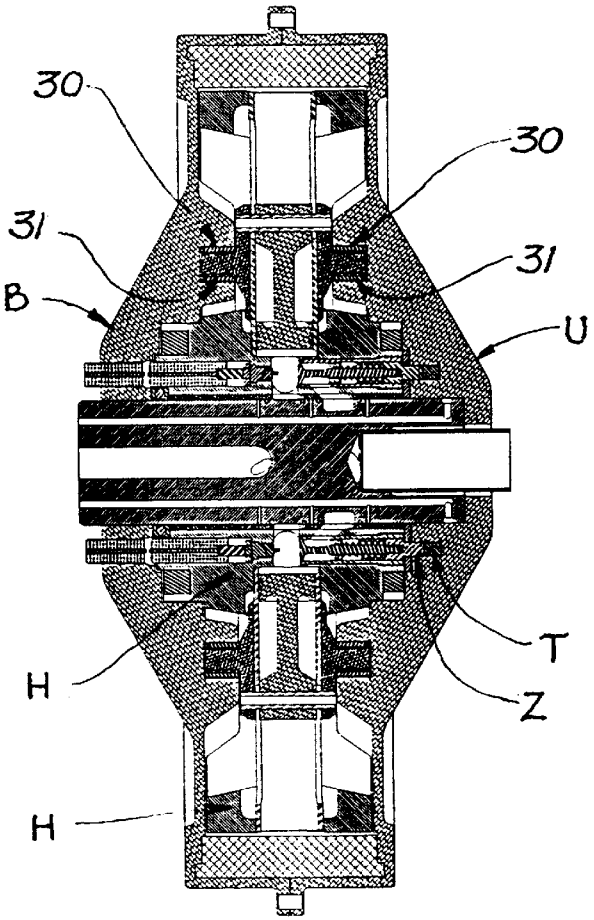
FIG. 4A is a full cross sectional view, similar to FIGS. 2A and 3A taken substantially along vantage line 4A—4A of FIG. 4 and looking in the direction of the arrows thereon including the front end case in the assembly of parts.
Figure 4:
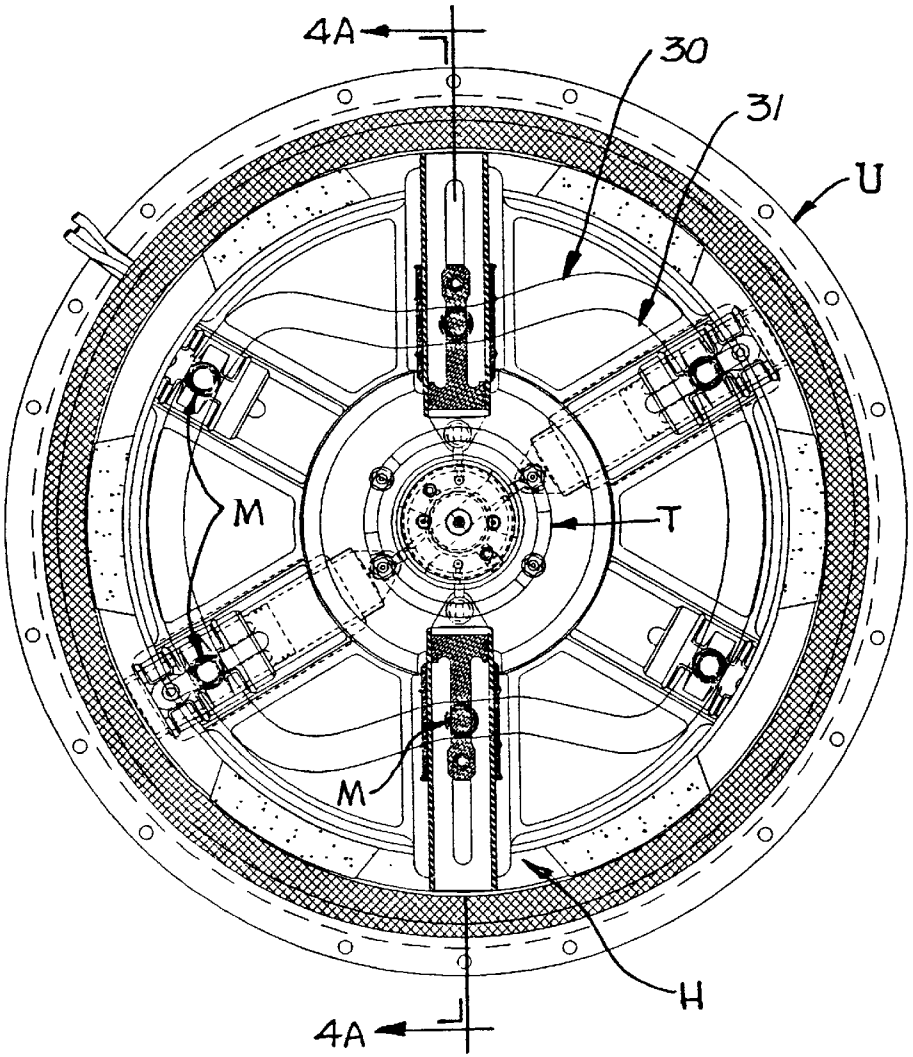
FIG. 4 is another end elevational view with the front end case removed as in FIGS. 2 and 3 and illustrating one half of the twin cam means and the relationship of cam rollers thereto.

As best shown in FIGS. 4 and 4A the cam roller bearings (M) operatively control and harness the movements of the pistons (K) in their respective cylinders. This activity is accomplished by means of twin stationary cam tracks 30 and 31 (see FIG. 4A) which are formed in opposing registration on the inside wall of both outer case housing sections (B) and (U). In operation the roller bearings (M) (except at engine start-up, when engaged briefly with cam surface 31) stay in constant contact with the outer wall or surface 30 of the outer stationary cam track; with the two cam tracks being of sufficient width to provide clearance between the cam roller bearings and the radially innermost wall surface 31 of the opposing cam track.

As shown in FIG. 4, each cam track 30 and 31 is asymmetrical for each half or 180° of rotor rotation during which a complete combustion cycle takes place. This cycle is then repeated again in the opposite 180° of rotor rotation. This twin cam design allows each cylinder to be fired twice per revolution of the rotor and therefore the six cylinder engine of the illustrated embodiment, if running at 1200 rpm for example, produces 14,400 complete combustion cycles per minute. Mathematically this result is computed by multiplying six cylinders times two firings per revolution which equals 12 complete combustion per revolution. That figure multiplied by 1200 rpm equals 14,400 complete combustions per minute. This is equal to the fire power produced by a 24 cylinder conventional four cycle engine running at the same speed or a twelve cylinder conventional two cycle engine running at the same speed. This result also may be accomplished by a conventional six cylinder, four cycle engine, for example, such as those commonly found in most standard automobiles in use today, running at 4800 rpm.

Shown in the elevational view FIG. 4 is the annular exhaust valve cam ring (T) which is securely mounted in the stationary end casing (U) (see FIG. 4A). Cam T is responsible for opening the poppet exhaust valves and holding them open as the exhaust valve cam followers (Z) pass over the cam ring in response to the rotational movement of rotor (H). In the normal depiction of the elevational view of FIG. 4, the exhaust valve cam ring (T) would not be shown or seen. Its full line showing in FIG. 4, however, is helpful for a better understanding of this engine.

Figure 5A:
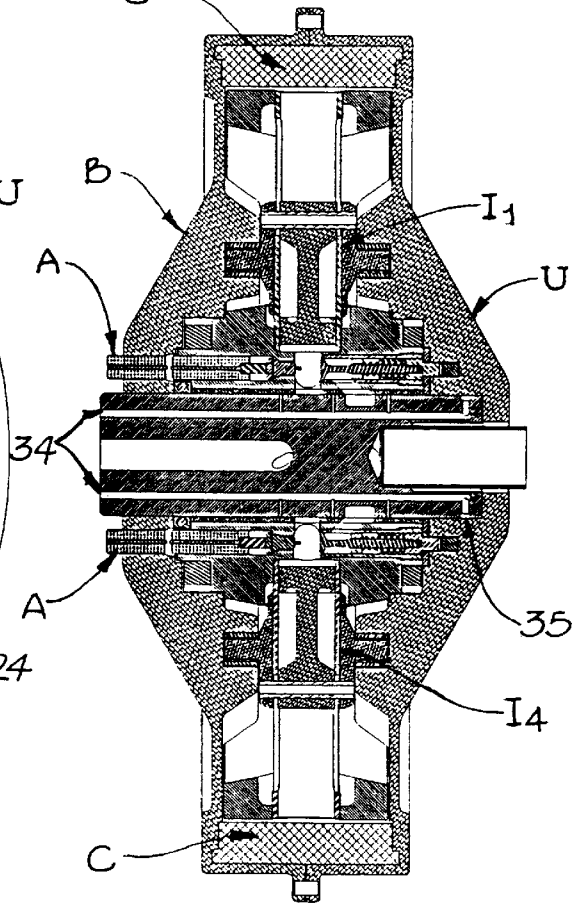
FIG. 5A is a full cross sectional view taken substantially along vantage line 5A—5A of FIG. 5, showing the missing front end case in assembly, and looking in the direction of the arrows thereon, similar to FIGS. 2A, 3A and 4A.
Figure 5:
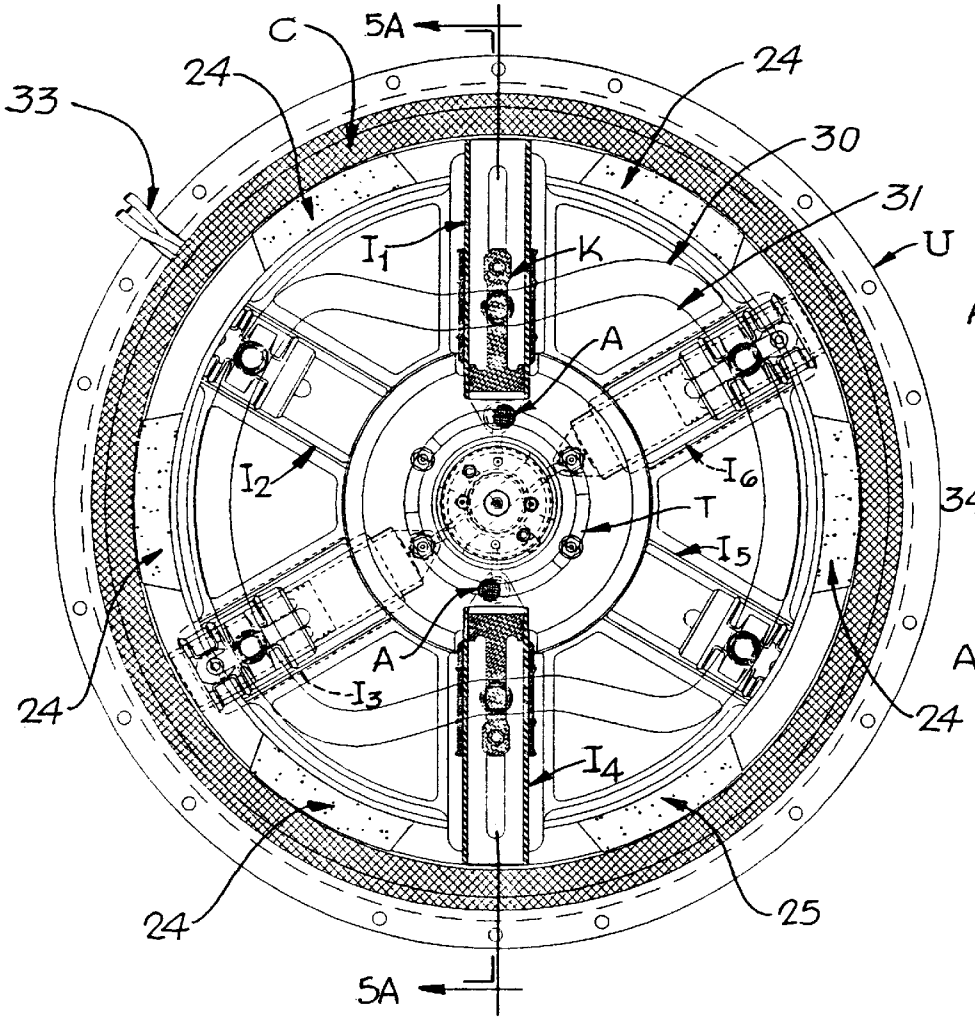
FIG. 5 is another end elevational view similar to FIGS. 2, 3 and 4 showing the arrangement of insulated electrodes which are mounted in the removed front end case.

Turning now to FIGS. 5 and 5A it will be recognized that insulated electrodes (A) are shown in FIG. 5 even though they are actually mounted in the missing front case (B) as best shown in FIG. 5A of the drawings. It will be appreciated that the electrodes (A), like the cam tracks and the exhaust valve cam ring (T) ordinarily would not be illustrated in this elevational view of FIG. 5 inasmuch as the front end case (B) is removed. However, these items are shown in full lines in FIG. 5 for the sake of promoting understanding of the workings of the engine/generator.

FIG. 5 also shows the six arcuate permanent magnets 24 disposed between the outer ends of adjacent cylinders, as previously noted. The stationary coil (C), which is held by and extends axially between the housing cases (U) and (B), is shown in FIG. 5A along with its output coil wires 33, seen in FIG. 5.

The main shaft oil lines 34 and oil supply manifold 35 at the inner end of the main shaft (Q) also are shown in FIG. 5A.

FIG. 5, like the FIGS. 2, 3 and 4, shows the positioning of engine parts at 0° of rotation for the rotor. The air-fuel mixture in the cylinders as shown in the sectional view FIG. 5A, has already been ignited and the pistons (K) shown in full lines in their respective cylinders (I)1 and (I)4 for instance, remain or are held stationary by cam surface 30 for the next 10° of rotation, neither moving radially in or out appreciably relative to the center line of the engine. This unique static dwell condition permits the ignited air-fuel mixture to burn more completely thereby causing cylinder pressures to reach a maximum potential before piston movement. Such action alone provides much greater efficiency and output horsepower as compared to the same volume of fuel consumed in a conventional engine.

Figure 6:
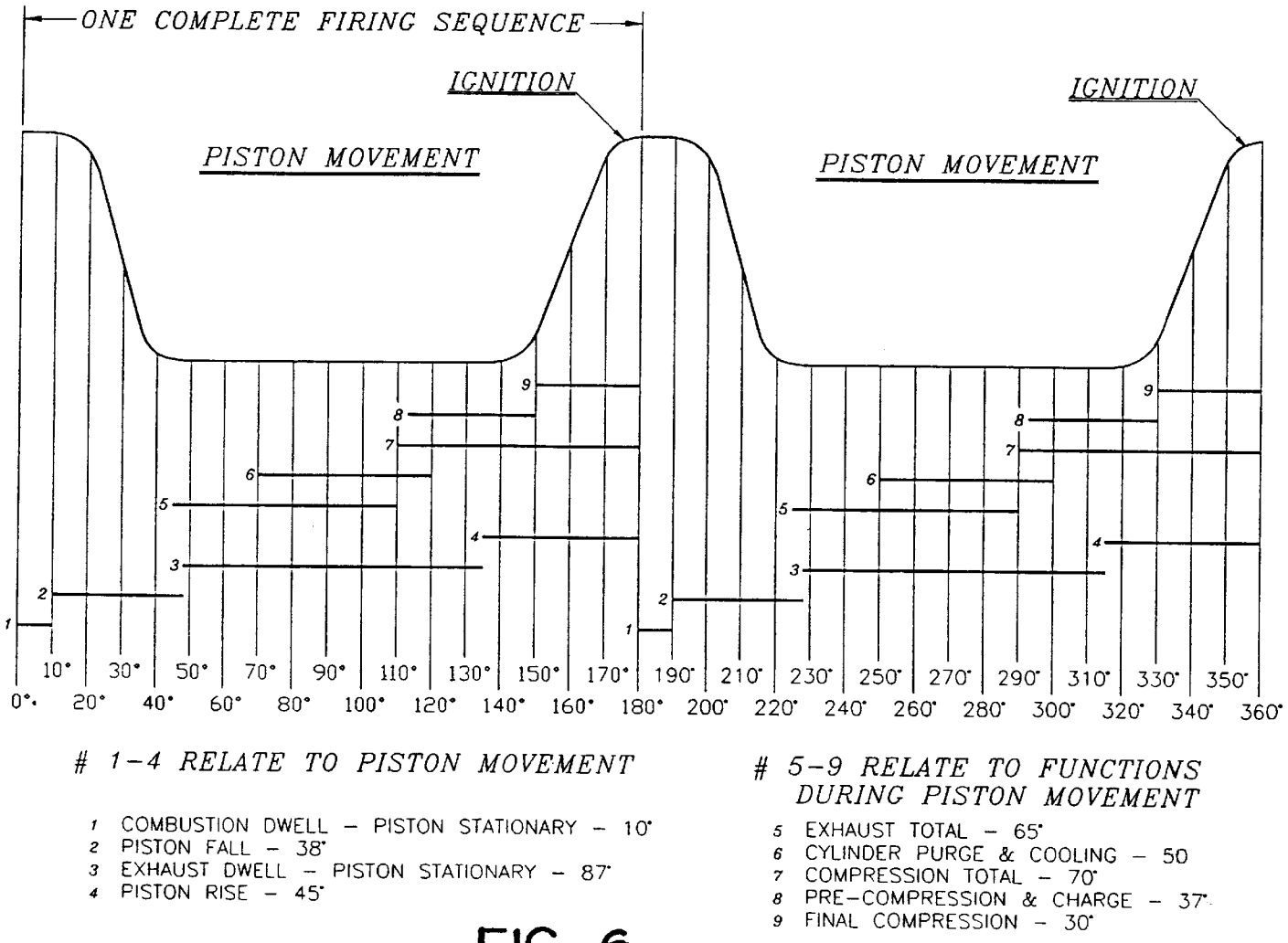
FIG. 6 is a diagrammatic graphic illustration of piston movements and functions occurring during two combustion cycles for a complete 360° revolution of the engine rotor.

Having set forth the character and operation of the basic mechanisms of the fuel cell engine, attention is directed now to the happenings taking place during a single revolution of the engine's rotor for which purpose attention is directed initially to FIG. 6 of the drawings. It will be recognized that FIG. 6 illustrates the unusual character of piston movement and also relates the various happenings and functions taking place during such movement.

Starting at 0° at the left hand side of the FIG. 6 graph, the combustion dwell is indicated by line 1 as extending from 0° to 10° of rotor rotation. As mentioned heretofore, each piston is held during this period in a relatively stationary position in its cylinder. In this condition the ignited air-fuel mixture is allowed to burn more completely, which thereby produces cylinder pressures of maximum potential before allowing the piston to move.

From 10° to 48° the piston is permitted to fall radially outward, as shown by line 2. This fall of the piston is very rapid and steep and produces very high torque at very low revolutions per minute, a condition which is however not always desirable. In the current engine/generator, this is a condition that is quite desirable since there is no outside gearing to worry about. All of the high torque produced by the engine is absorbed evenly by the entire casing in the act of making electricity. The casing therefor can be made much lighter with no fear or failure caused by heavy unevenly distributed loads applied to it from outside rotational forces.

At 3° prior to the end of piston fall, as indicated by line 2, the exhaust cycle is initiated as shown by line 5, with exhaust dwell beginning at the end of the piston fall. The term "exhaust dwell" is not necessarily accurate when referring to the period of time the piston is relatively stationary at the bottom of its stroke as indicated by line 3. As shown, there is a lot more going on than simply exhausting the cylinder. The exhaust dwell period starts at 48°, while exhaust starts at 45° with a cylinder purge and internal cooling sequence starting at 70°. These operations are indicated by lines 5 and 6. The exhaust cycle ends at 110°, when the exhaust valve is fully closed. Therefore, compression (line 7) begins at 110° while the cylinder purge and cooling port are still open. At 113° a precompression and charge cycle begins (see line 8). Meanwhile cylinder purge and cooling (line 6) continues to pump fresh air into the cylinder until 120° whereat the purge port closes which helps to charge the cylinder quickly. At 135° the dwell (line 3) terminates.

At 135° the piston rise (line 4) moves the piston radially inward toward the center of the engine/generator, and precompression and charge (line 8) continues until 150° of rotation is reached whereat the pressurized intake port closes. Final compression (line 9) begins at 150° of rotation and continues to 180°, although the compressed air fuel mixture is ignited at 175°. Ignition at this point in the cycle is 5° prior to the next dwell period which commences at 180°; the next combustion dwell (line 1) starting the above described entire combustion sequence all over again.

Figure 7:
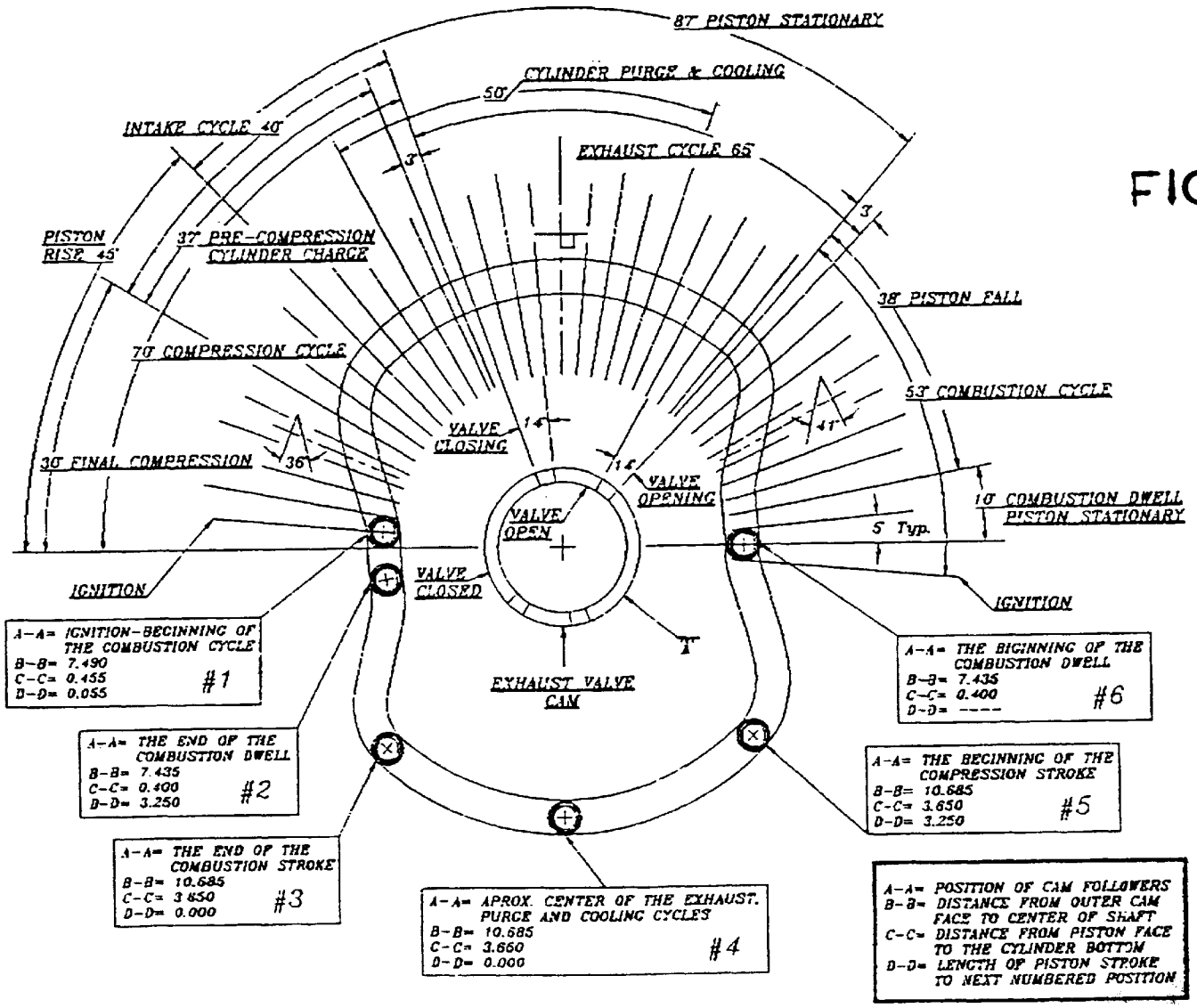
FIG. 7 is a graphic illustration of the cam track layout in which the cam related functions illustrated in the graphic of FIG. 6 are indicated in particular.

It will be noted that the functions described and set out in FIG. 6 of the drawings in the form of a graph are shown again in co-relation to the cam track layout illustrated in FIG. 7 of the drawings.

With reference to FIG. 7 the top half of that figure reflects the graph data shown in FIG. 6, while the bottom half of that figure addresses the position of the cam track and pistons relative to the center of the engine/generator main shaft (Q). Exhaust valve cam ring (T) is shown in the center of the layout. It is believed that the reader will find FIG. 7 to be self-explanatory particularly when taken in conjunction with FIG. 6 of the drawings. It is further to be noted from the bottom half of FIG. 7 that the position of the cam followers (M) relative to the center line of the engine/generator's main shaft are set out. This is indicated by dimension A—A at each of six positions of the cam followers illustrated. B—B is shown as the distance from the outer cam face to the center of the shaft; C—C is the distance from piston face to the cylinder bottom and D—D is the length of piston stroke to the next numbered position.

In the remaining drawings 8–13 major events happening inside the engine/generator during one complete combustion sequence are illustrated. For purposes of clarity all these drawings show parts that are normally stationary as rotating and parts that are normally rotating as stationary.

Figure 8A:
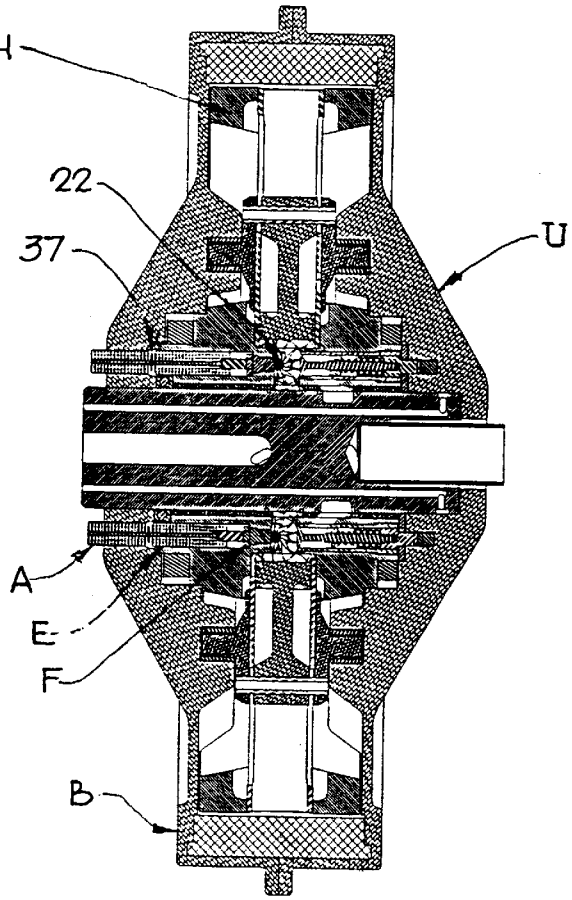
FIG. 8A is a cross sectional view taken substantially along line 8A—8A of FIG. 8, looking in the direction of the arrows thereon and showing the engine/generator of FIG. 8 assembled with its front end case in mounted position.
Figure 8:
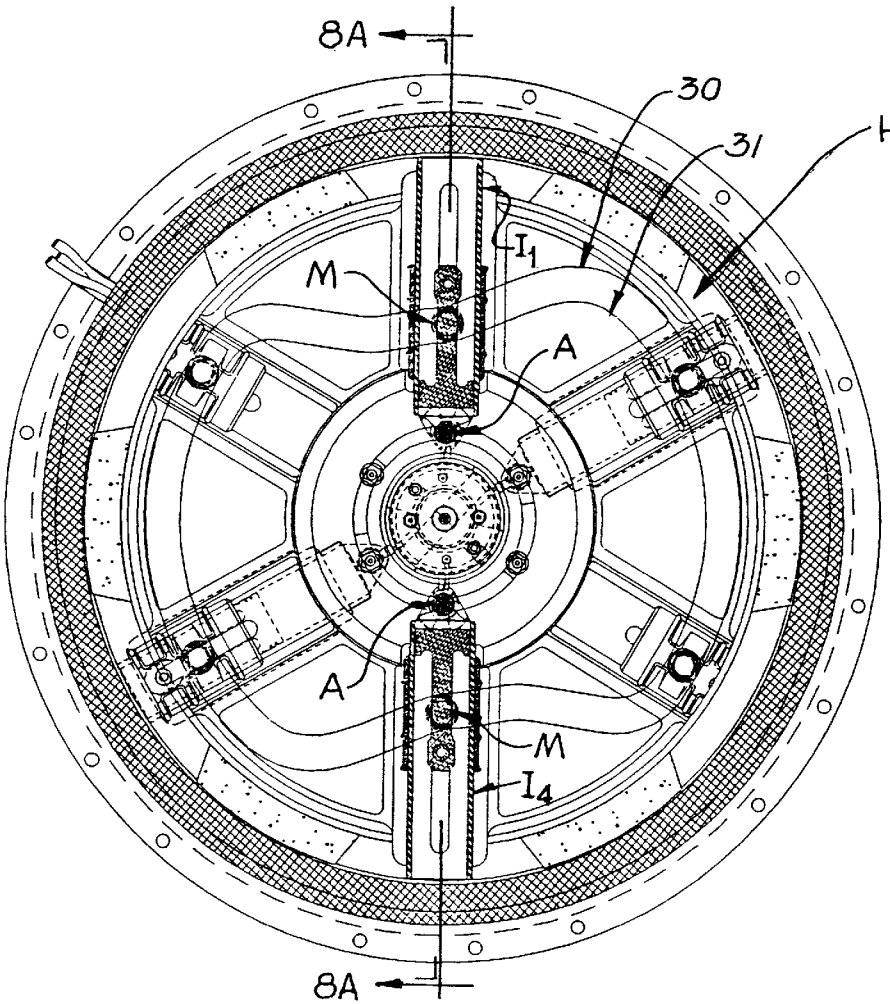
FIG. 8 is an end elevational view similar to FIGS. 2–5 with the front end case removed, illustrating the relationship of parts during dual cylinder ignition and for clarity purposes, showing parts which are normally stationary as rotating, and parts normally rotating as stationary.

Referring initially to FIG. 8 of the drawings where ignition is occurring, rotor (H) is at a position of 355° (or 5° prior to the combustion dwell at 0° of rotor rotation). As previously mentioned, fuel is ignited early to provide additional pressures needed to keep the cam roller bearings (M) from launching off the outer face 30 of the cam track at the top of a piston stroke. Insulated electrodes (A) in the front case (B) are in alignment with the spark plug insulators (E) carried in rotor (H). As best shown in FIG. 8A, a spark 37 is jumped across the gap between electrodes (A) and the insulators (E) and concurrently in combustion chamber 22; it being understood that the two opposing cylinders (I)1 and (I)4, illustrated, counter balance opposing forces on the main shaft (Q) upon ignition of the fresh air/fuel mixture in the cylinders as described.

Figure 9A:
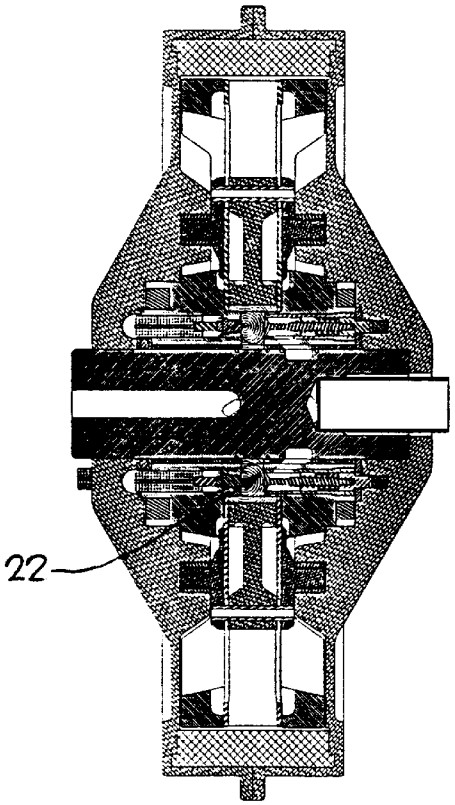
FIG. 9A is a cross sectional view taken substantially along vantage line 9A—9A of FIG. 9, showing the engine/generator thereof with the removed front end case in mounted position.
Figure 9:
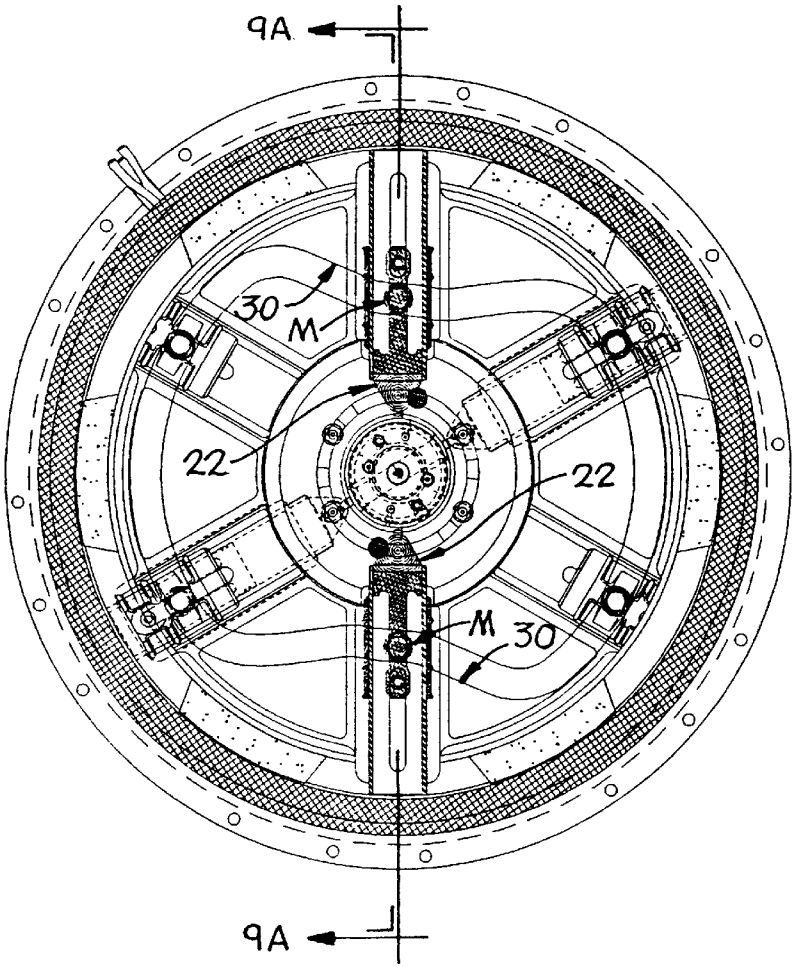
FIG. 9 is an elevational view similar to FIG. 8 showing the engine/generator thereof with front end case removed and illustrating the position of parts at the end of the combustion dwell.

The end of combustion dwell is illustrated in FIGS. 9 and 9A which shows the engine rotor at 10° of rotation at the end of combustion dwell (see FIG. 6). Fuel has actually been ignited 15° prior to the end of combustion dwell and the piston remains relatively stationary in its position in the cylinder during the dwell. Meanwhile the combusted air/fuel mixture has had sufficient time to achieve its optimum pressure within combustion chamber 22. Cam roller bearings (M) are about to start their descent down the outer cam face 30 of the cam track. Since the action of the two opposing cylinders at 180° are performing the same functions simultaneously vibrational effect is substantially eliminated in the engine.

Figure 10A:
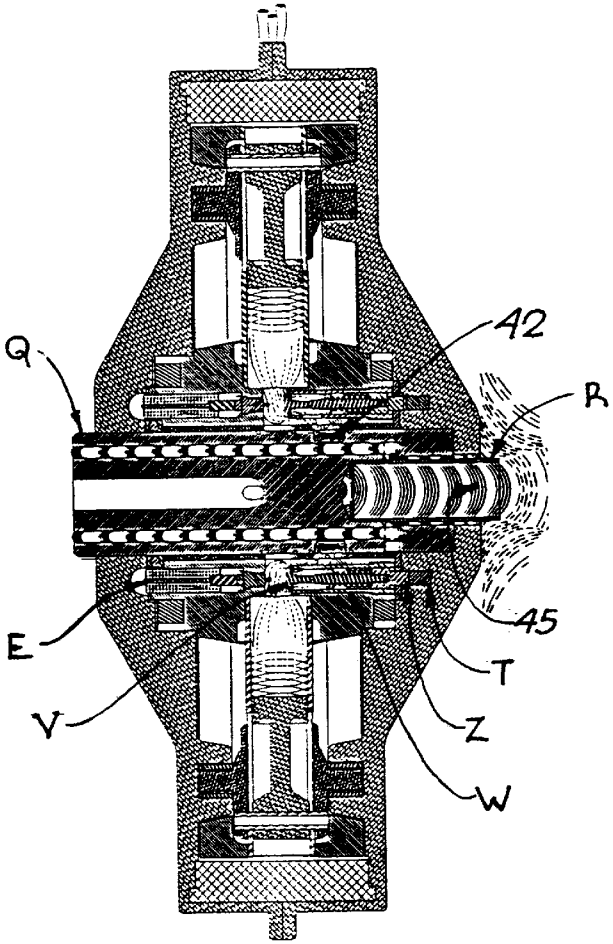
FIG. 10A is a cross sectional view taken substantially along vantage line 10A—10A of FIG. 10 and looking in the direction of the arrows thereon.
Figure 10:
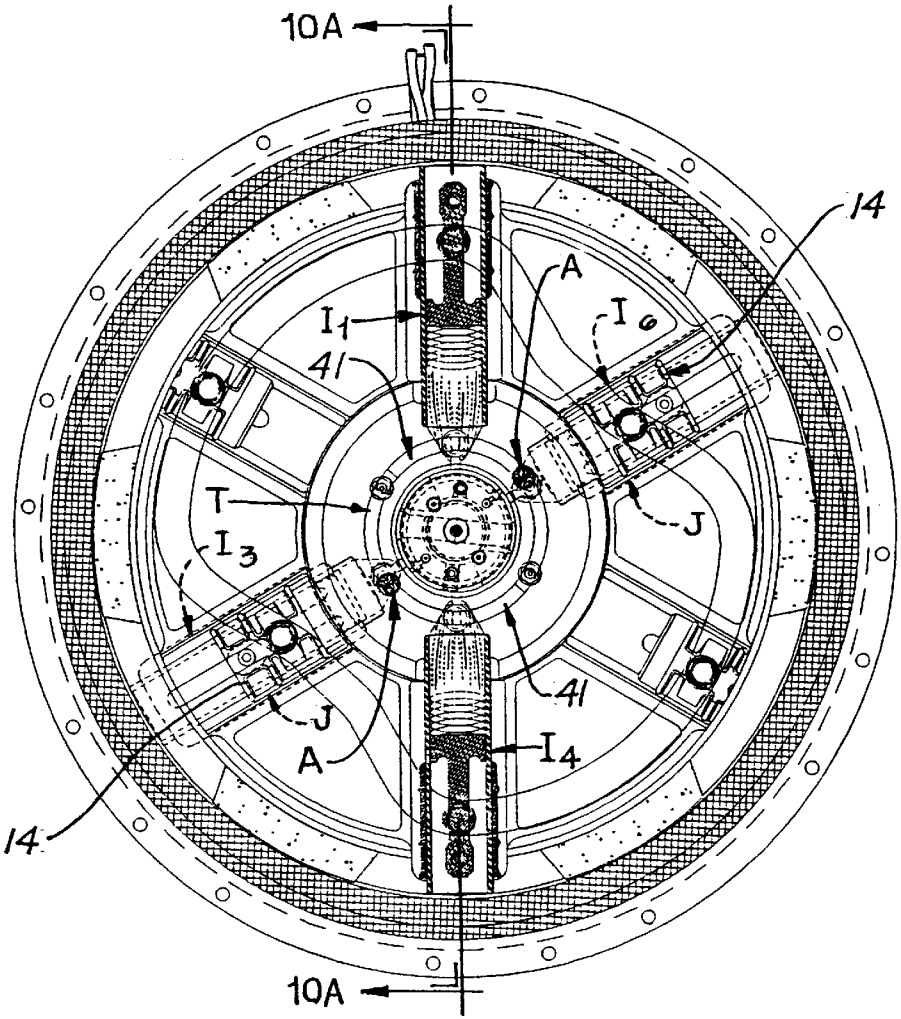
FIG. 10 is an end elevational view similar to FIG. 9 with front end case removed and illustrating the end of combustion stroke for two of the pistons.

FIGS. 10 and 10A illustrate the condition and position of parts at the end of a combustion stroke with the rotor at 48° of rotor rotation. Each piston (K) in the two cylinders (I)1 and (I)4 is as far from the center of the engine/generator main shaft (Q) as it will get. Exhaust valve cam followers (Z) came into contact with the elevated sections 41 of the stationary exhaust valve cam ring (T) three degrees (3°) earlier and valve stems (V) are moving away from their seats in the valve bodies (W). These valves will not be fully open for another 11° of rotor rotation, but spent gases are already exiting the cylinders past the partially open valves into the exhaust manifold ring 42 which is inset into the exterior perimeter of the main shaft (Q). Exhaust gases travel along the exhaust manifold ring until they reach ports that connect the exhaust manifold ring to the exhaust pipe (R). These exhaust ports are shown best in FIG. 12A of the drawings at 43 and 44.

Referring to FIG. 10A the exhaust gases can be seen leaving the engine/generator at 45 through the exhaust pipe (R).

Figure 10B:
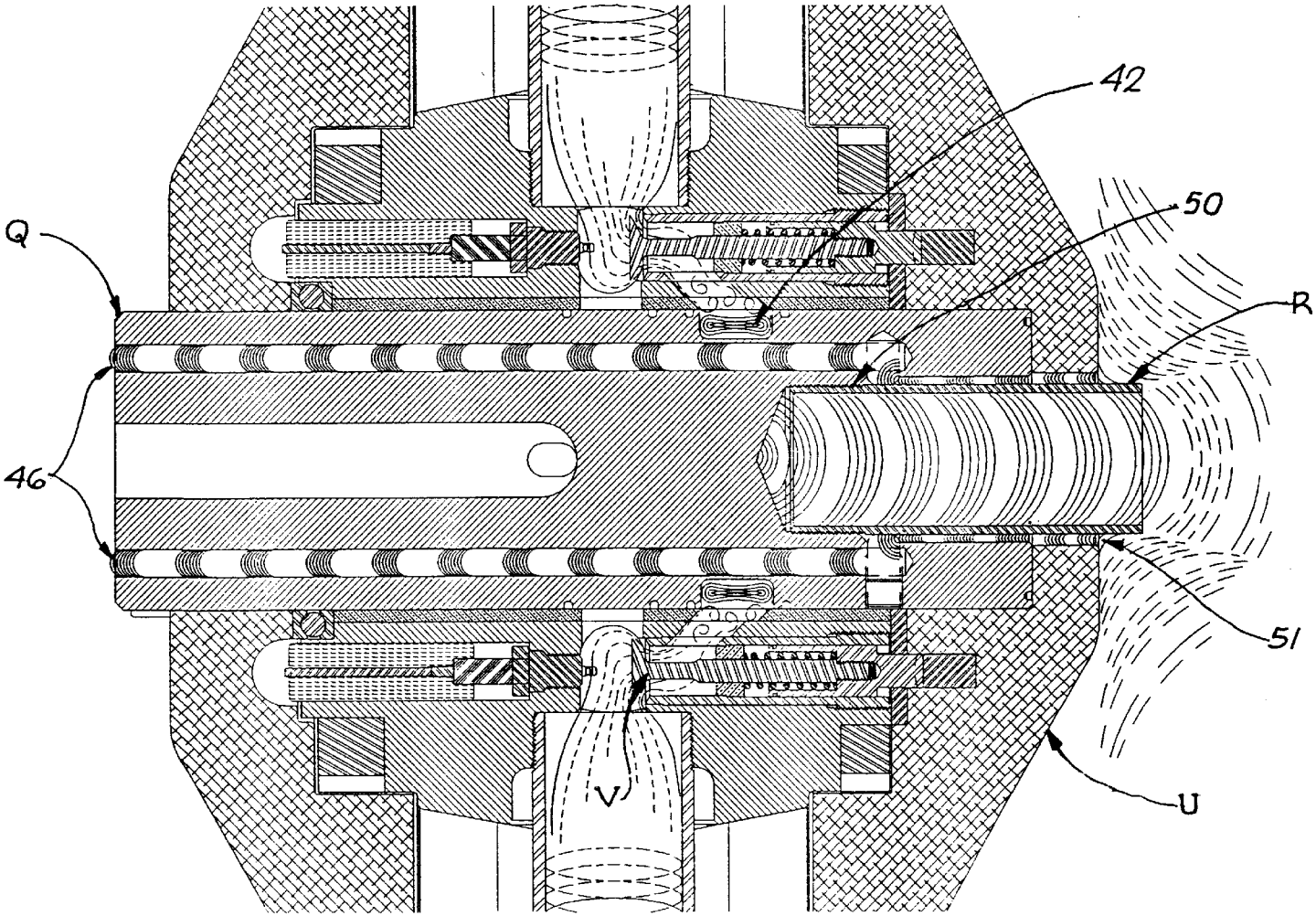
FIG. 10B is a partial blown up view the central area of FIG. 10A illustrating the cooling ports, exhaust passages and indicating exhaust gas flows.

It will be understood that FIG. 10B is a blown up portion of section 10A—10A of the cross sectional FIG. 10A keeping in mind that all the parts which are normally stationary are shown as rotating. It will be noted that two main shaft cooling ports 46 are shown in the main shaft (Q). The exhaust pipe (R) is only in contact with the main shaft where it is threadingly attached to (Q) as indicated at 50. For the rest of its length through the main shaft and the end case (U), pipe (R) is provided with circumferential clearance to allow for free flow of cooling air 51 which is drawn in from the outside of the engine/generator, past the bottom end case (U) and the lower portion of the main shaft, to flow about the outside diameter of the exhaust pipe and out through the two cooling ports 46 to the front of the engine. Since the back end of the engine tends to be warmer due to the exhaust and the front of the engine tends to be cooler, due to the intake of fresh air and fuel mixture, the temperature differential has an equalizing effect on the main shaft.

Referring back to the FIG. 10 it will be noted that the present position of the insulated electrodes (A) and the two cylinder sleeves (J) shown with full and hidden lines at (I)3 and (I)6 are only 7° from the start of their combustion sequence whereat the insulated electrodes (A) come into alignment with their respective spark plug insulators (E).

Figure 11A:
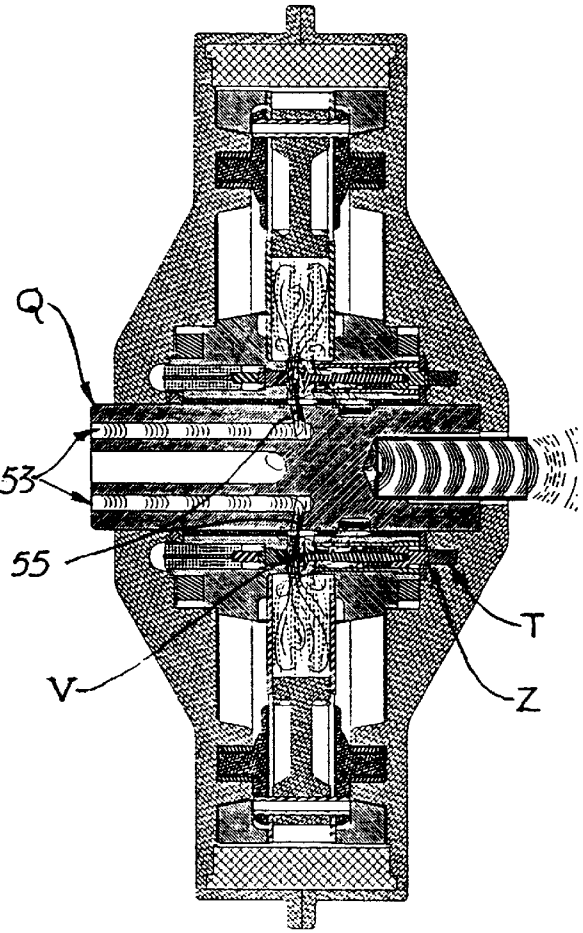
FIG. 11A is a cross sectional view taken substantially along vantage line 11A—11A of FIG. 11 and showing the engine/generator of FIG. 11 with the front case mounted.
Figure 11:
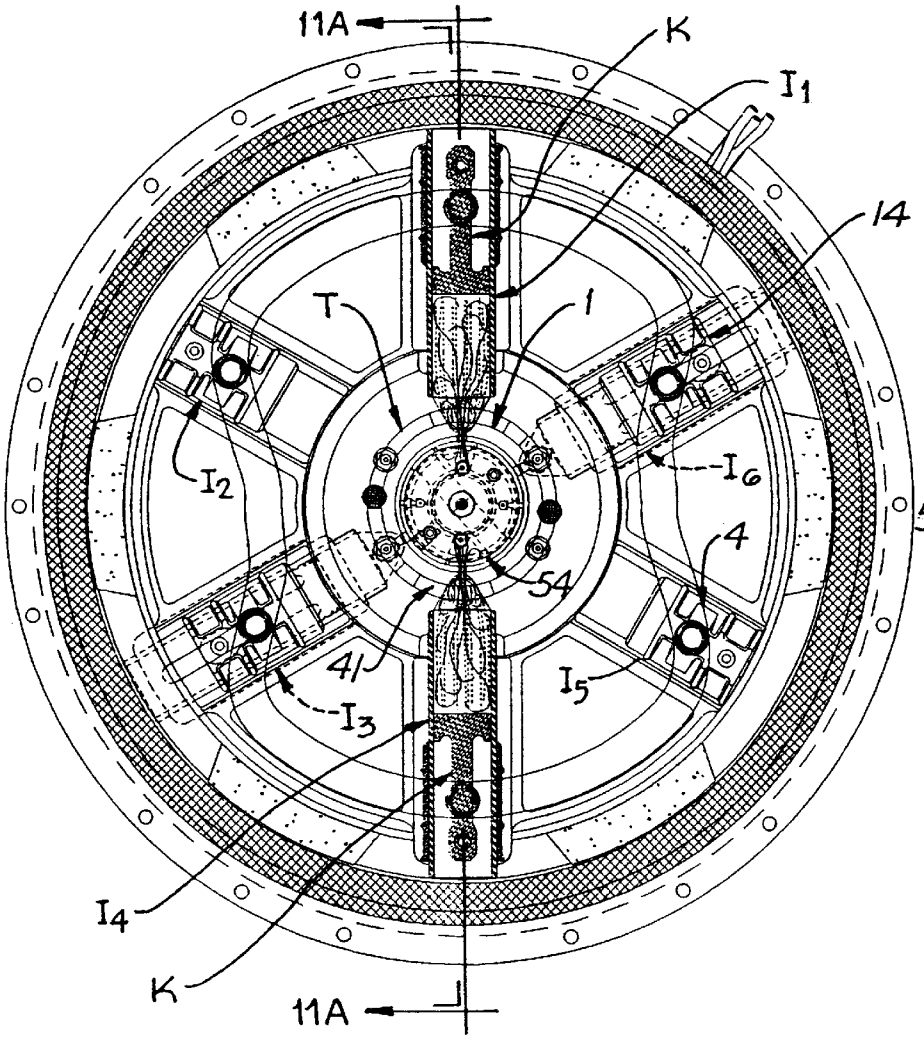
FIG. 11 is still another end elevational view similar to FIG. 9, with front end case removed, illustrating the engine rotor at 90° of rotation.

FIGS. 11 and 11A show the engine/generator of this invention at 90° of rotor rotation at which position the exhaust cycle has been active for 45° of rotation and is designed to continue for another 20° before valve stem (V), which is fully open, as shown in FIG. 11A, will fully close.

Importantly, the cylinder purge cycle starts 20° earlier and will continue for another 30° of rotation. Both of these operations are completed when the pistons (K) are still in the same relatively stationary position relative to the cylinders as they were in at the end of their combustion stroke 42° earlier. In fact from this point, the pistons remains relatively stationary for another 45° of rotation.

The exhaust valve cam followers (Z) (see FIG. 11A) are fully elevated at the extended raised plateaus 41 of the stationary exhaust valve cam ring (T). As a result, the valve stems (V) are fully open and have been held fully open for 31° at this stage. Such valve stems will continue to be held fully open for another 6°. Also, note that the main shaft (Q) cylinder purge and cooling ports 53 are now shown.

It should be noted that the present position of the two cylinder sleeves (I)3 and (I)6, shown in full and hidden lines, are at 30° of rotation just slightly past half way through their combustion strokes. Both of these cylinders are producing tremendous amounts of rotational force on the rotor (H). Also, at this time the two cylinder sleeves (I)2 and (I)5, which are shown in full lines with no hidden lines are just starting their final combustion cycle and are only 25° from their next ignition and 30° from their next combustion dwell.

Figure 11B:
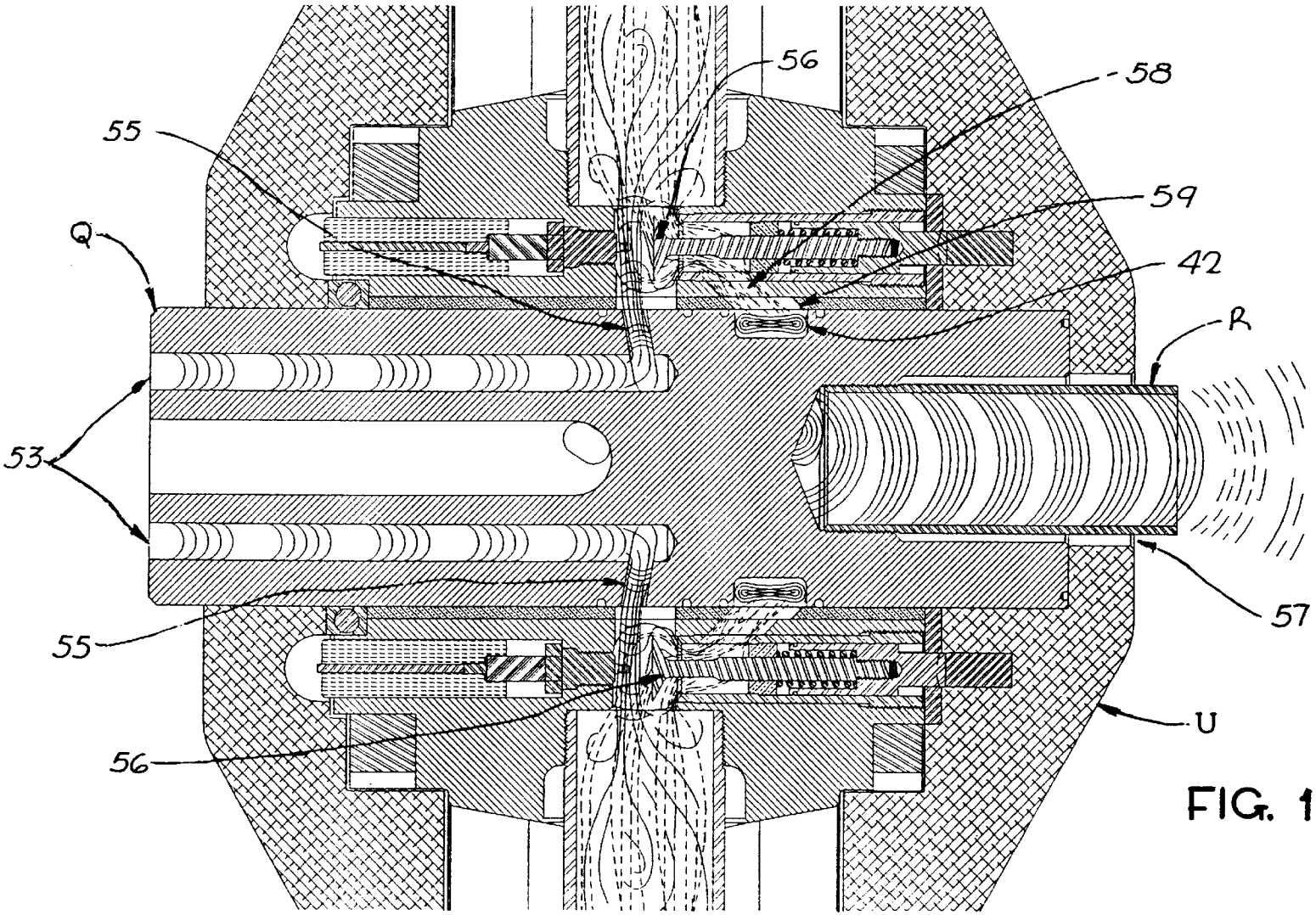
FIG. 11B is a blown up central portion of the cross sectional view set out in FIG. 11A, illustrating internal cylinder purging and cooling activity.

In FIG. 11B, which is a blow-up of the central portion of cross sectional FIG. 11A, the two purge and cylinder cooling ports 53 are clearly seen. The triangular shape of the actual port openings into the cylinder can be seen in the elevational view of FIG. 11 at 54. In FIG. 11B one can also see the compound angles of cooling port 55, as it aligns with the combustion chamber.

Although the exhaust valve stem (V) is fully open, as indicated at 56, purge and cooling air is directed by way of the angular partial port opening 55, thereby forcing the cooling air past the fully open valve stem 56, through the combustion chamber, past the spark plug and into the cylinder, across the top of the piston and then back out of the cylinder through the open exhaust valve assembly. As this purge and cooling air escapes past the open exhaust valve assemblies it also cools the rotor exhaust ports 58, the main bearing exhaust ports 59, the exhaust manifold ring 42 in the main shaft (Q), the exhaust ports in the main shaft (see 44 of FIG. 12A) and the exhaust pipe (R), as well as the engine/generator exhaust.

This described action represents the second and third systems for cooling the engine/generator; the first having been seen in FIG. 10B where cool outside air is drawn in from the back of the engine/generator and out through the main shaft through ports 46. The pre-heated air which is drawn out of ports 46 in FIG. 10B is used either fully or partially in the cylinder purge and cooling ports 53 in FIG. 11B. This provides an advantage in more closely controlling the internal temperatures of the engine for better combustion results. When the engine is cold, this system is effective to improve combustion by drawing cold air in around the exhaust pipe (R) as indicated by the circumferential clearance 57 to preheat such air as it passes over the exhaust pipe (R) which is then used to warm the engine combustion chambers. Conversely it is desirable when the engine is running hot under a heavy load or extreme outside temperature, to use fresh air or a blend of fresh air and preheated air to achieve the best internal operating temperatures for the engine.

The third method of cooling this engine is by way of lubricating oil which is sprayed on the cylinders and rotor assembly near the combustion chambers when the engine/generator is running.

Figure 12A:
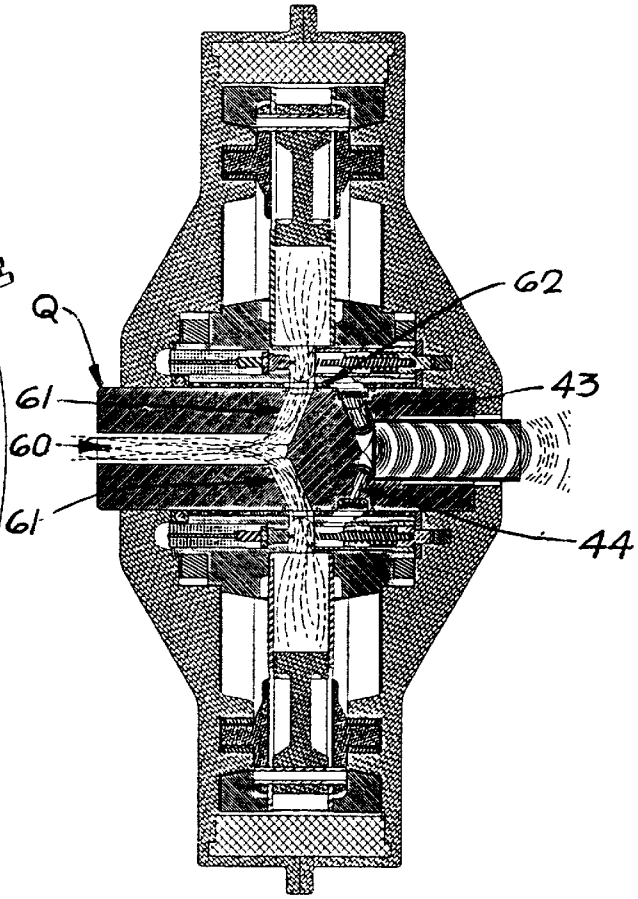
FIG. 12A is a cross sectional view similar to FIG. 11A, taken substantially along vantage line 12A—12A of FIG. 12 and looking in the direction of the arrows therein with the removed front end case in assembled position.
Figure 12:
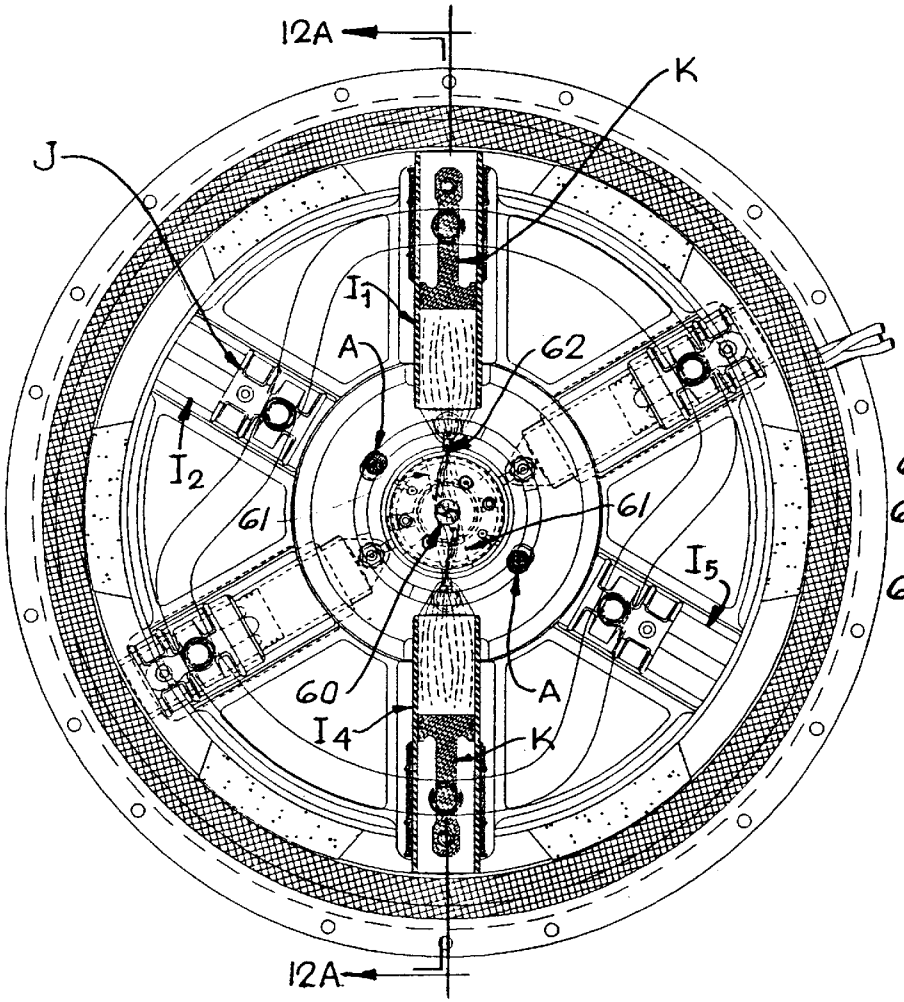
FIG. 12 is another end elevational view, similar to FIG. 11, with front end case removed, showing the engine/generator at fuel intake.

In FIGS. 12 and 12A the engine/generator is depicted at 120° of rotation. The exhaust valves have been fully closed for 10° of rotation, the purge and cooling ports have just closed completely and the precompression and cylinder charge ports started to open 7° earlier at 113°. The pistons (K) in cylinders (I)1 and (I)4 remain substantially stationary and will remain that way for another 15° while the cleaned and purged cylinders are charged with a fresh charge of air and fuel. It can be seen that the intake port 60 in the main shaft (Q) branches off into two separate rectangular branch ports 61, which are the precompression and cylinder charge ports. As these ports align with the combustion chamber ports 62 in the rotor, the cylinders are filled and precompressed with a fresh/new air-fuel mixture. The exhaust ports 43 and 44 can also be seen as they connect the exhaust manifold ring 42 to the exhaust pipe. Exhaust port 43 is shown in a manner to emphasize its circular or round cross sectional shape. The port shown at 44 is more reflective of the actual view through section 12A although it is to be understood that both ports are of the same diameter running through the main shaft at the same angle in mirror images of one another.

Exhaust gases are visible in the exhaust manifold ring and exhaust ports (FIG. 12A) although the exhaust valves and the cylinders shown in FIG. 12A are both closed. The reason for this is that the cylinders (I)3 and (I)6 are in their exhaust cycle while the cylinders (I)2 and (I)5 are just beginning combustion dwell having had ignition 5° earlier as can be seen by the position of the insulated electrodes (A) (FIG. 12).

Figure 13A:
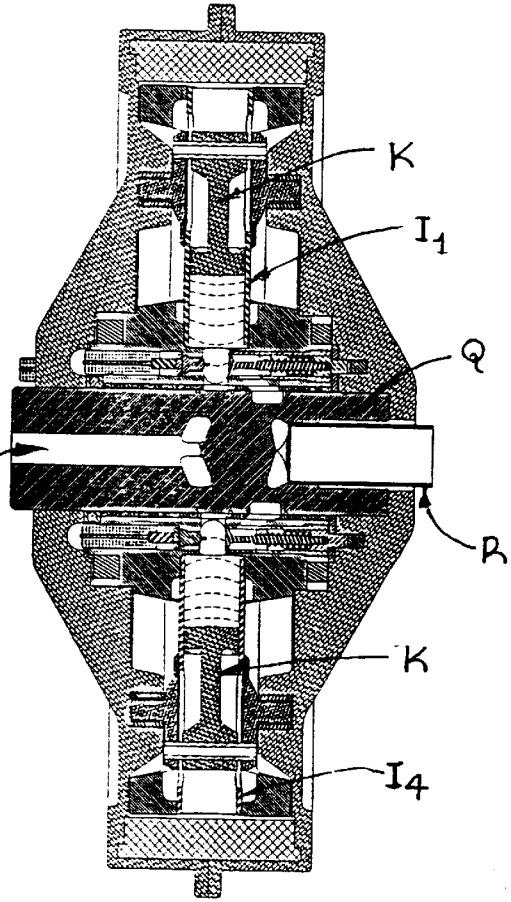
FIG. 13A is a full cross sectional view taken substantially along vantage line 13A—13A of FIG. 13, with the front end case in assembled position.
Figure 13:
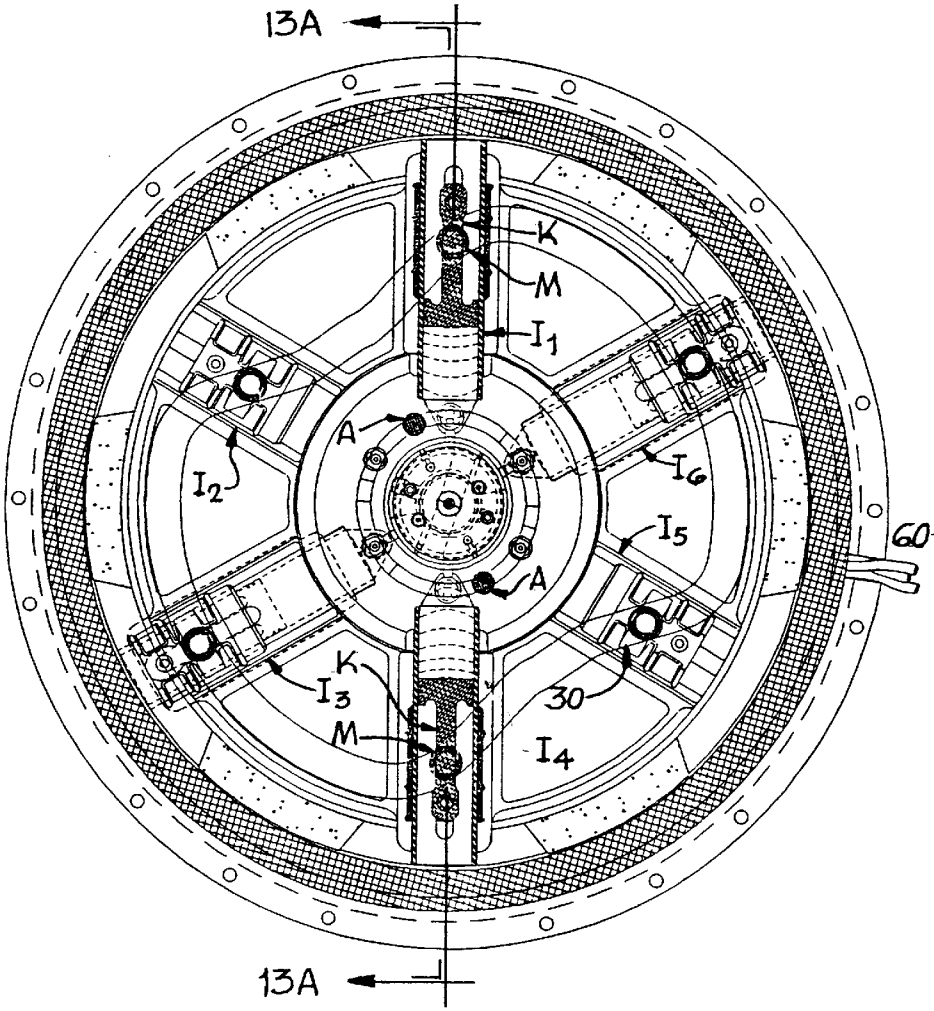
FIG. 13 is still another end elevational view of the engine/generator with front end case removed, similar to FIGS. 11 and 12; showing the beginning of the compression cycle.

The final FIGS. 13 and 13A of the engine/generator are at 150° of rotor rotation. The rotor is in a cycle of final compression during which all valves, of course, are closed to the combustion chambers. The pistons (K) in cylinders (I)1 and (I)4 illustrated in these figures started to move radially inwardly toward their combustion cycle 15° earlier and for the last 30° will continue toward the center of the engine/generator. This is caused by the cam follower bearings (M) in contact with the inclining outer cam track surface 30. After 25° of rotation the spark plugs will again ignite the air/fuel mixture within the cylinders and the engine will be back to where it started in the first drawings of this series (FIG. 8), but on the opposite side of the engine. The cylinders I(2) and I(5) as shown in FIG. 12, that were in the beginning of their combustion dwell in FIG. 12, are now shown in FIG. 13 approximately half way down the declining slope of the cam track face 30 in the combustion cycle. At this time both of the cylinders I(2) and I(5) are producing and transmitting large amounts of rotating force to rotor (H).

It will be recognized that the foregoing explanation associated with the FIGS. 1–13A have followed the events occurring in one half of one full revolution of the engine/generator. In FIGS. 8–13, only 180° of rotation is involved. During this 180° travel, each of the six cylinders fires one time. It is to be recognized by one familiar with the interior workings of a typical engine that the herein disclosed engine represents a giant leap forward in the search for a power dense, economical, dependable and reliable source of electrical power useful for virtually any and all portable, as well as stationary applications.

Having described this invention, it is believed that from the foregoing those skilled in the art will readily recognize and appreciate the novel advancement represented by this invention and will understand that the embodiment hereinabove described and illustrated in the accompanying drawings, while being preferred, is susceptible to modification, variation and substitution of equivalents without departing from the spirit and scope of the invention, which is intended to be unlimited by the foregoing, except as may appear in the following appended claims.

What is claimed is:

1. A unitary engine generator, comprising:

an internal combustion engine incorporating a rotatably driven central rotor supporting plural radially extending, arcuately spaced cylinders rotatable with said rotor about a central longitudinal axis;

a piston moveable coaxially within each of said cylinders;

a stationary unitary housing encasing said engine coaxially of said axis;

a pair of registeringly aligned, like, axially spaced endless cam tracks formed integrally with opposing interior walls of said housing;

a pair of cam followers associated with each said piston;

each cam follower operationally engaging an adjacent one of said cam tracks;

means in bearing relation with the exterior of each of said cylinders for interjoining a related pair of said cam followers and a respectively associated piston whereby combustion actuation of each piston serves to drive said cam followers along said cam tracks;

a stationary field winding fastened to the interior periphery of said housing, concentrically surrounding said rotor and cylinders; and at least one magnetic mass mounted for movement with said rotor to generate electrical energy in response to orbital movement of said mass past said field winding.

2. The engine/generator of claim 1, wherein said engine is a two cycle, multiple cylinder, rotary piston engine operable to fire each cylinder multiple times during each revolution, characterized by only two directional reversals of each piston per combustion sequence.

3. The engine generator of claim 2, wherein said cam tracks of said engine are designed to provide a prolonged dwell period at the top and bottom of each piston's stroke, whereby each said piston is substantially stationary relative to its associated cylinder during both dwell periods.

4. The engine/generator of claim 1, wherein said engine is a two-cycle type, comprising a single poppet type valve per cylinder which controls exhaust, purge and cooling cycles while preventing the escape of unconsumed fuel from each cylinder into the atmosphere.

5. The engine/generator of claim 1, wherein said cam tracks are disposed in registering diametrically opposed relationship on opposite sides of said cylinders for controlling operational movements of said pistons.

6. The engine/generator of claim 5, wherein each cam track is formed as part of a single endless cam defining a 360° rotational rotor orbit; each said cam defining plural symmetrical sections of said orbit with respect to said axis and each of said sections defining plural asymmetrical portions of said orbit with respect to said axis.

7. The engine generator of claim 1, wherein said cam tracks are configured to provide variable piston combustion strokes to optimize combustion of selected fuels.

* * * * *